US006694650B2

(12) United States Patent
Brown

(10) Patent No.: US 6,694,650 B2
(45) Date of Patent: Feb. 24, 2004

(54) APPARATUS FOR DISPLAYING PAPER AND LIKE OBJECTS

(75) Inventor: Sandra Guy Brown, 6104 Donnybrook Rd., Raleigh, NC (US) 27606-9774

(73) Assignee: Sandra Guy Brown, Raleigh, NC (US)

( * ) Notice: Subject to any disclaimer, the term of this patent is extended or adjusted under 35 U.S.C. 154(b) by 0 days.

(21) Appl. No.: 09/838,641

(22) Filed: Apr. 19, 2001

(65) Prior Publication Data

US 2002/0152651 A1 Oct. 24, 2002

(51) Int. Cl.[7] ..... G09F 1/00; A47G 1/06; B42F 13/00

(52) U.S. Cl. ..... 40/124.2; 40/735; 40/775; 402/79

(58) Field of Search ..... 40/124, 124.06, 40/124.2, 721, 722, 735, 768, 771, 775, 790, 791, 605, 729, 730; 402/79; 211/45, 48, 50, 55, 72, 73

(56) References Cited

U.S. PATENT DOCUMENTS 4,532,727 A * 8/1985 Klose et al. ..... 40/729
5,305,537 A * 4/1994 Pascarelli ..... 40/661
5,316,404 A * 5/1994 Hensel ..... 40/721
5,323,552 A 6/1994 Fritz
5,339,547 A 8/1994 Fogel
5,651,202 A 7/1997 Hewitt
5,797,204 A * 8/1998 Paulos ..... 40/124.2
5,850,705 A * 12/1998 Groh ..... 40/124.2
5,893,229 A 4/1999 Werner
6,052,933 A 4/2000 Lytle
6,282,826 B1 * 9/2001 Richards ..... 40/775
6,349,491 B1 * 2/2002 Able ..... 40/124.01

OTHER PUBLICATIONS

US 2003/0059248 A1, Walton, Mar. 2003.*
US 2002/0197098 A1, Palmer, Dec. 2002.*

* cited by examiner

*Primary Examiner*—S. Joseph Morano
*Assistant Examiner*—Jason R. Bellinger

(57) ABSTRACT

An apparatus for displaying and/or dispensing paper and like objects, such as artwork, photographs, sports cards, brochures and business cards whether such objects are made of paper, plastic or a like medium. The apparatus comprises a backer panel that serves as a background and support for a pocket panel. The pocket panel has a pocket or pockets formed between a front sheet and a back sheet. The pocket panel is attached to the backer panel by suitable means such as an adhesive, heat sealing, hook-and-loop fastening, double-sided tape or the like. The backer panel is made from a rigid or flexible, colored or translucent material of a suitable composition and may be decorated or have a texture suitable for receiving markings or captions. The pocket panel may be made from a transparent or translucent material so that a paper or like object contained within a pocket in the pocket panel is visible from outside the pocket. Each pocket in a pocket panel has a provision for insertion of a paper and like object into the pocket. A pocket panel may have a pocket configured for the ready dispensation of paper and like objects held within such a pocket. The backer panel may have means for hanging or for attachment to a surface and may have means for connection, along an edge or edges of the backer panel to connect with another, similar backer panel or panels to join together to form an arrangement of backer panels in a variety of configurations.

1 Claim, 4 Drawing Sheets

APPARATUS FOR DISPLAYING PAPER AND LIKE OBJECTS

BACKGROUND OF THE INVENTION

There are numerous prior art apparatus for displaying and/or dispensing paper and lie objects. Such apparatus include photograph albums, picture frames, wall hangings, display racks, display stands and bulletin boards. The apparatus available today do not have the capability to display and/or dispense a collection of objects of a variety of sizes in a flexible and variable configuration.

U.S. Pat. No. 5,893,229 (issued Apr. 13, 1999 to Werner) discloses an apparatus for displaying photographs, certificates and the like. Using the Werner apparatus, articles are mounted by the use of static cling sheets and, in some embodiments, with double-sided tape or an adhesive strip for additional support. Werner does not disclose an apparatus that is capable of dispensing or displaying an entire collection of objects or of holding more than one object per frame. Mounting each individual object in a collection of objects using the Werner apparatus would require a large amount of space. The Werner frame does not have means for attachment to a second such frame.

U.S. Pat. No. 5,323,552 (issued Jun. 28, 1994 to Fritz) discloses a way to display one or more photographic prints by providing a set of pockets. The Fritz device has connection devices that allow for one such device to be connected to a second such device. Fritz does not allow for attachment of or intermixing multiple size pockets together. The Fritz apparatus has no background panel that can have decorative or other attributes nor does it provide for a means for dispensing objects.

U.S. Pat. No. 5,651,202 (issued Jul. 29, 1997 to Hewitt) discloses an expandable sports card holding device with an expandable frame and finger slots to facilitate removal of sports cards. Hewitt does not disclose provisions for holding other size objects nor for dispensing objects.

U.S. Pat. No. 5,339,547 (issued Aug. 23, 1994 to Fogel) discloses an apparatus for displaying greeting cards, sports cards photographs and the like. The Fogel apparatus is a tabletop, floor or wall display rack having slots to hold articles of different size articles. The Fogel apparatus offers no protection for displayed articles nor does Fogel disclose a configuration in which a single slot may hold a number of objects for both display and dispensation purposes.

There remains a need for an apparatus for displaying and/or dispensing objects that is versatile, flexible, interchangeable, simple and is economical to manufacture.

SUMMARY OF THE INVENTION

The present invention is an apparatus for displaying paper and like objects such as photographs, business cards, brochures, sports cards and artwork. The apparatus may also be configured so that it can dispense such objects. The apparatus comprises a backer panel, a pocket panel having one or more pockets for displaying and/or dispensing such objects, means for attaching the Docket panel to the backer panel, means for hanging the backer panel or attaching the backer panel to a surface and, in some embodiments, means for connecting the backer panel to another, similar backer panel. The backer panel can be made of a suitable flexible or rigid material, may contain decorative designs and/or have a surface texture suitable for receiving markings or captioning. The scope of the invention encompasses a backer panel that is adapted to hanging from a wall, window or door such as a curtain or drapery or adapted to attach to a surface such as a wall, a bulletin board or a chalkboard. The scope of the invention encompasses a backer panel that may be attached to other, similar backer panels to form arrangements of a variety of layouts. Thus, a user may join two or more backer panels together to form a display arrangement of nearly any length or width. The pocket panel has a transparent or translucent front sheet and either a print, colored, or opaque, transparent or translucent back sheet with a pocket or pockets formed between the two sheets. Each pocket has an opening through which a paper or like object can be inserted for displaying and/or dispensing. By using pocket panels of different configurations and sizes, a user can display objects of different sizes in the same arrangement. A pocket in a pocket panel provides protection to an object inserted in the pocket for display or dispensing.

DESCRIPTION OF THE PREFERRED EMBODIMENTS

Figure 1:
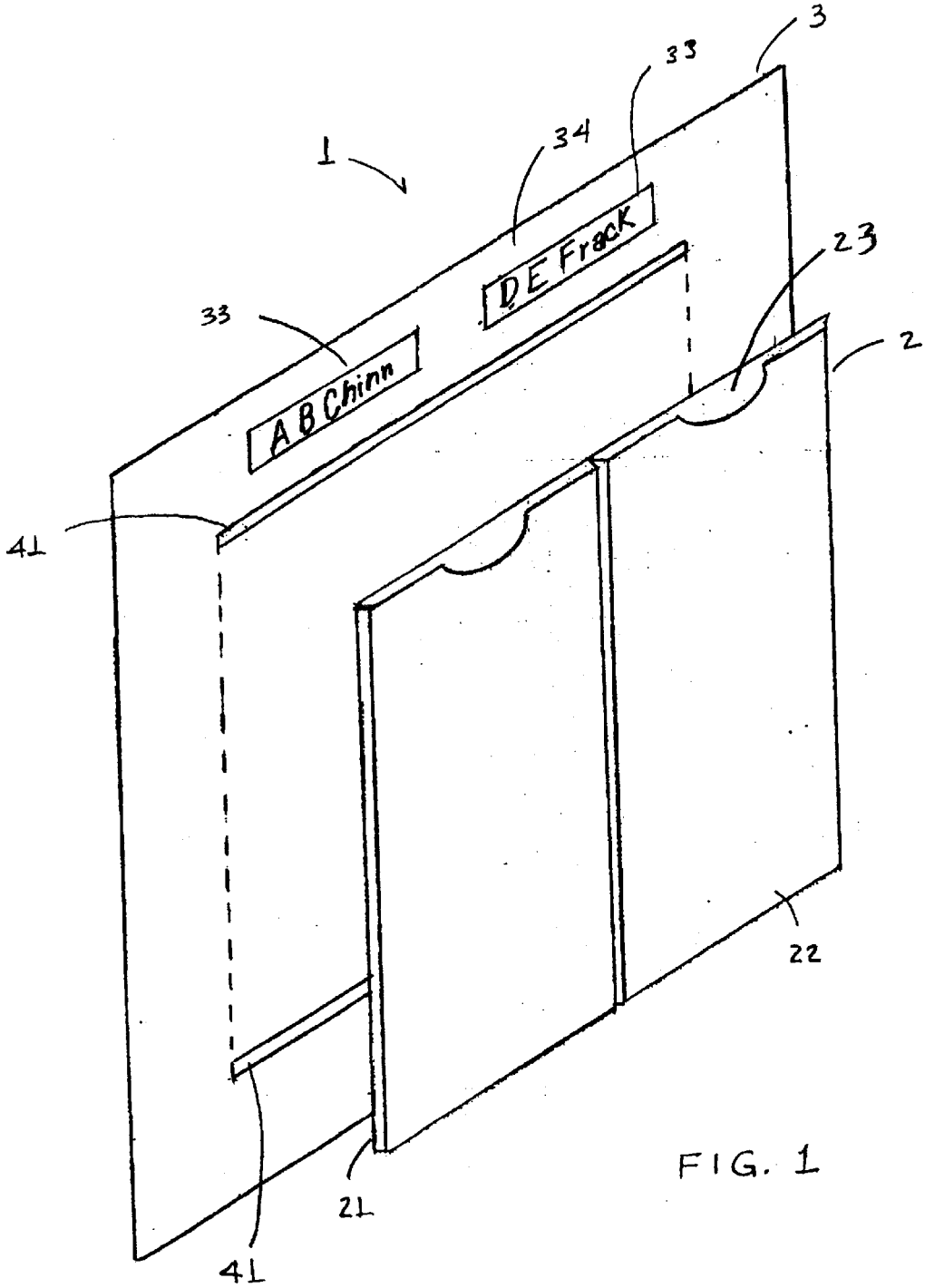
FIG. 1 is an isometric view of the apparatus of one embodiment of the present invention.

FIG. 1 depicts a preferred embodiment of apparatus 1 for displaying and dispensing while protecting paper and like objects. Apparatus 1 comprises backer panel 3 having means for attaching pocket panel 2 to backer panel 3. Different embodiments of the apparatus may comprise includes backer panels 3 in a variety of sizes, ranging from one suitable for displaying a card or single paper sheet sized objects to a size suitable for use as a curtain or drape in a window or doorway. Backer panel 3 has an outside edge 34. Edge 34 of backer panel 3 may have a configuration that allows for a bordered surface around a pocket panel 2. Such a surface could be one of a decorative print or of a solid colored material that would accept a marker, crayon, ink, dye or some type of decal for decoration or captions 33. Pocket panel 2 has front sheet 22 and back sheet 21, the two sheets being heat sealed or otherwise joined to have formed between them at least one pocket 23. Back sheet 21 is preferably formed of a translucent, transparent or colored material of various textures and may vary from flexible to rigid. Front sheet 22 may be formed of a plastic sheet material and is preferably transparent or translucent, so that objects inserted into pocket 23 may be viewed through front sheet 22.

Figure 2:
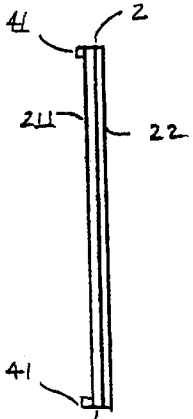
FIG. 2 is a side elevation view of pocket panel of the invention.

FIG. 2 shows a side elevation view of a pocket panel 2 of the present invention. There may be means for attachment 41 on rear side 211 of back sheet 21 for attaching pocket panel 2 to a backer panel 3 (FIG. 1).

Figure 3:
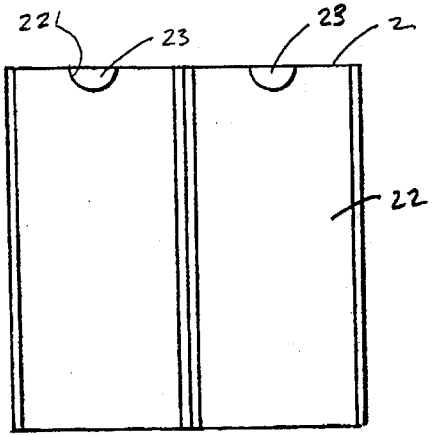
FIG. 3 is a front elevation view of the pocket panel.

FIG. 3 shows one embodiment of the present invention in which a pocket panel 2 has two like sized pockets 23. As discussed more fully below, a given pocket panel 2 may contain different sized pockets 23 so that an appropriately configured apparatus may hold a variety of sizes of objects. Front sheet 22 preferably contains a finger cutout 221 so that a user may grasp objects in the pocket.

Figure 4:
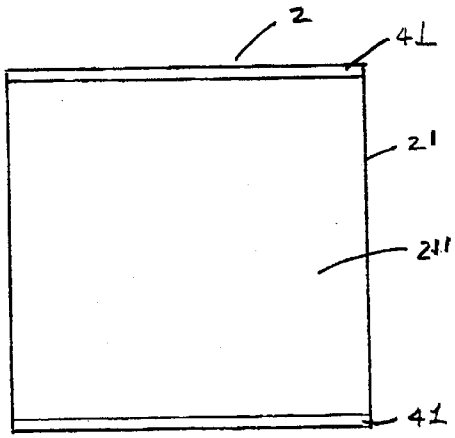
FIG. 4 is a rear elevation view of the pocket panel.

FIG. 4 shows rear side 211 of back sheet 21 of pocket panel 2 with means for attachment 41 to backer panel 3. Means for attachment 41 is affixed to rear side 211 of back sheet 21 so that pocket panels 2 can be attached to backer panel 3. Attachment means 41 may comprise double-sided tape, hook-and-loop fasteners, adhesives, buttons and buttonholes, snap fasteners or the like. Each pocket panel 2 may attach to a backer panel 3 in a variety of configurations.

Figure 5:
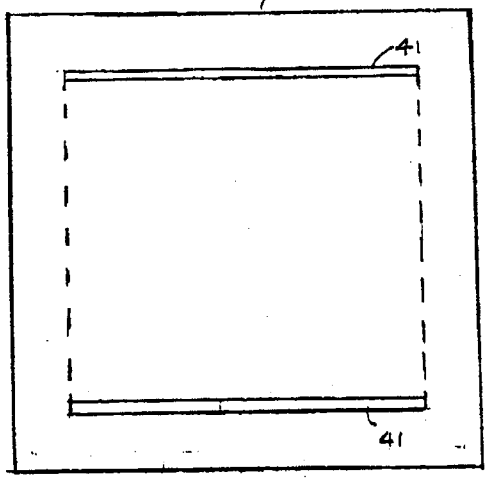
FIG. 5 is a front elevation view of one embodiment of a backer panel of the present invention.

FIG. 5 depicts a front elevation view of one embodiment of backer panel 3. In this embodiment, backer panel 3 has means for attachment 41 for a pocket panel 2 shown in FIG. 1. Attachment means 41 may comprise double-sided tape, hook and loop fasteners, buttons, snaps or the like.

Figure 6:
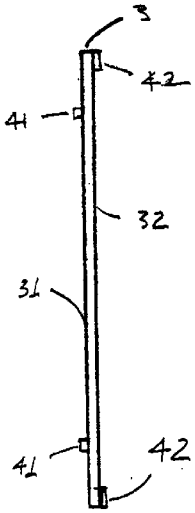
FIG. 6 is a side elevation view of the backer panel depicted in FIG. 5.

Shown in FIG. 6 is a side elevation view of the backer panel 2 depicted in FIG. 5. Rear side 32 of backer panel 3 may have means for attachment 42 so that backer panel 3 may be attached to a support member (not a part of the apparatus of the invention) such as being hung as a curtain or drape in a window or doorway or from a surface such as a wall or display board. Attachment means 42 may comprise hooks, hook-and-loop fasteners, double sided tape, adhesives or the like. Front side 31 of backer panel 3 may have attaching means 41 for attaching pocket panels 2 to backer panel 3.

Figure 7:
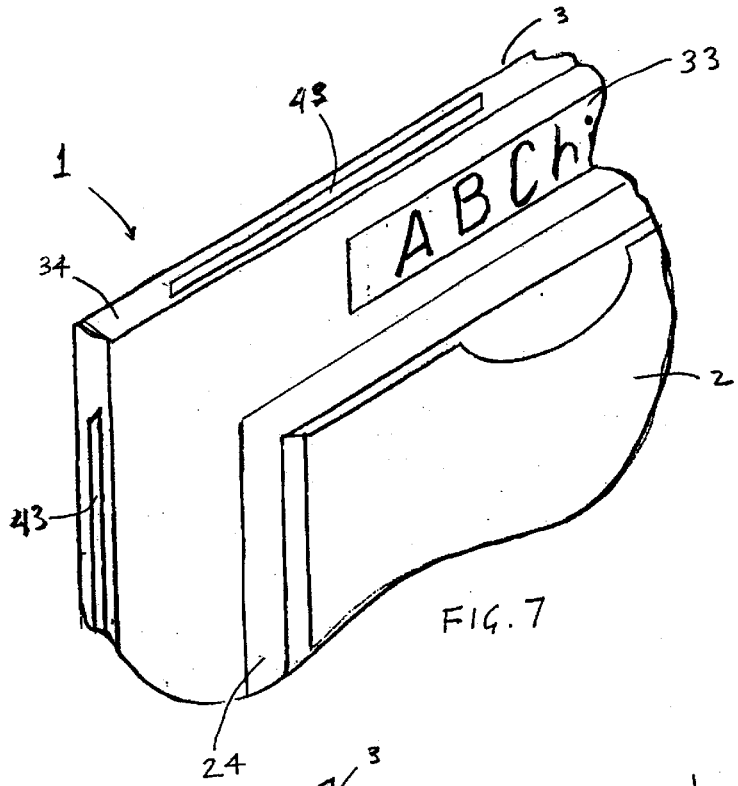
FIG. 7 is an isometric partial view of another embodiment of the present invention.

FIG. 7 shows a partial isometric view of an embodiment of the present invention. In the embodiment shown, pocket panel 2 is in position to be attached to backer panel 3. Around the periphery of backer panel 3 is an edge 34. Edge 34 has one or more means for attaching 43. Attaching means 43 allows backer panel 3 to be attached to one or more similar backer panels. Attaching means 43 may comprise buttons, snaps, hook and loop fasteners, double-sided tape or the like. The size and configuration backer panel 3 may vary so as to allow for the configuration of the pocket panels to be attached to it. Edges 34 may also be used to hang backer panel 3 using conventional means such as a tack or nail as well as for decoration, caption 33 or the like. Pocket panel 2 may also have an edge 24 to allow for decoration or the like.

Figure 8:
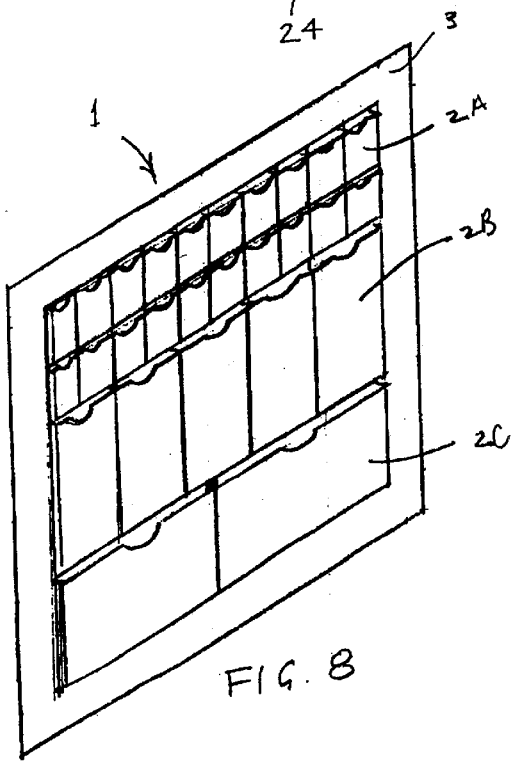
FIG. 8 is an isometric view of a second embodiment of the present invention.

FIG. 8 illustrates an embodiment of the apparatus of the invention in which there are several variant pocket panels, 2A, 2B and 2C attached to a single backer panel 3. Each of the pocket panel variants has pockets of different sizes and each of the variants themselves is of a different overall size.

Figure 9:
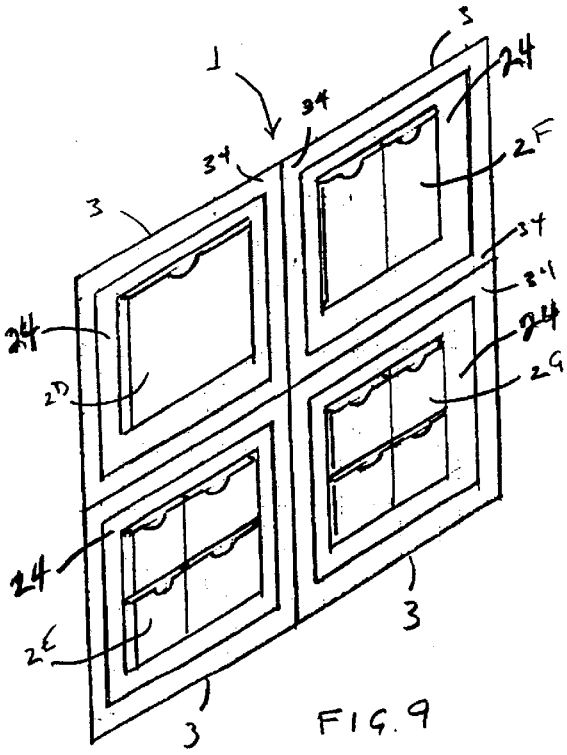
FIG. 9 is an isometric view of still another embodiment of the present invention.

FIG. 9 shows still another embodiment of the apparatus of the present invention in which there are several variant pocket panels, 2D, 2E, 2F and 2G attached to a single backer panel 3. Each of the pocket panel variants is of the same overall size but each variant has pockets of a different size.

Figure 10:
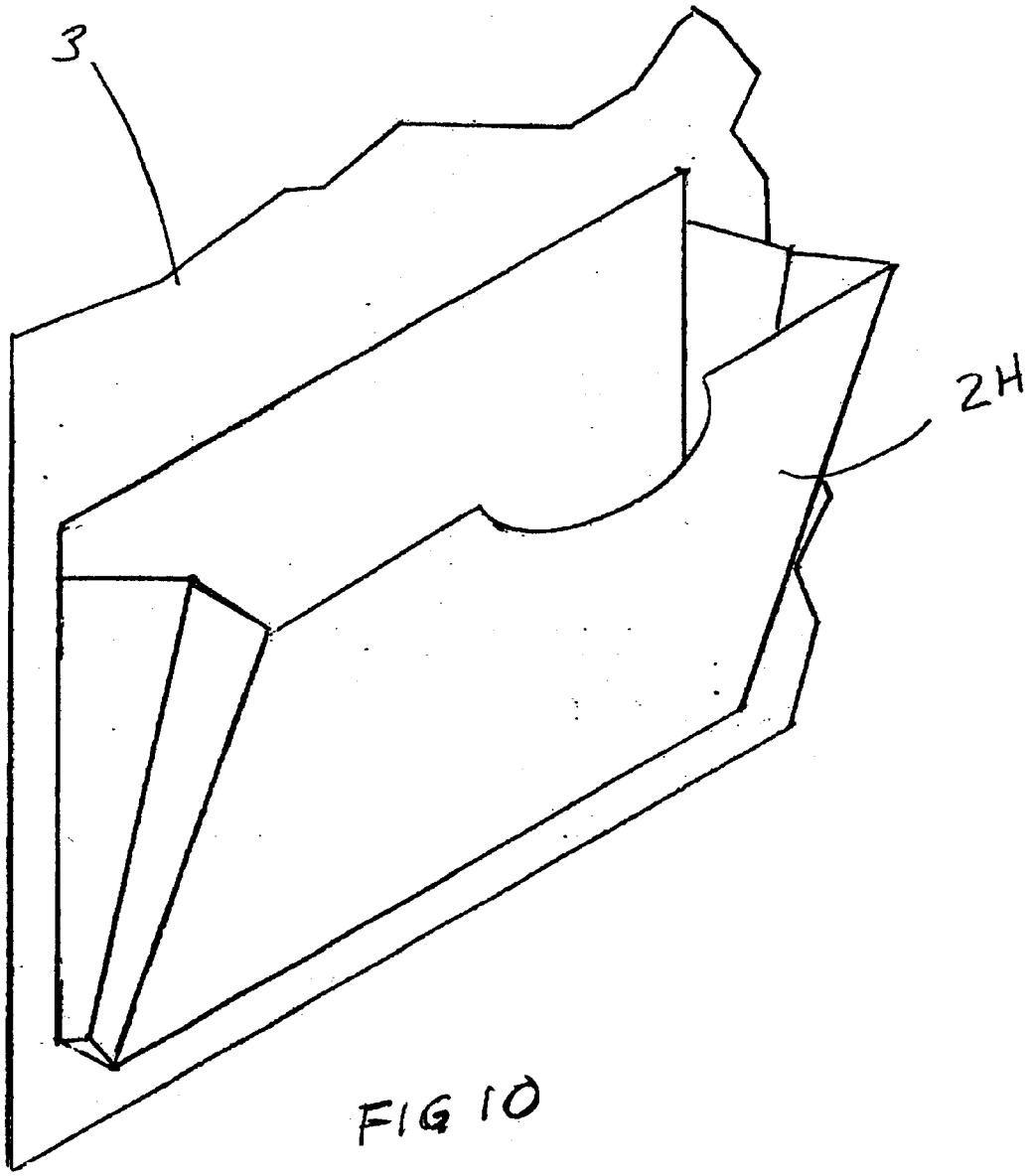
FIG. 10 is an isometric view of a feature of another embodiment of the present invention.

FIG. 10 shows a further variant embodiment of the apparatus of the present invention. In this embodiment, pocket panel 211, attached to backer panel 3, is made so that it can contain several paper or like objects. A pocket panel made in this configuration is adaptable to serve as a container and dispenser of objects such as business cards.

The present invention envisions that the display apparatus could be manufactured with adjacent backer panels being attached to each other and delivered to the user in rolls or accordion-fold configuration (not illustrated). The user could then detach as many backer panels from a roll as desired. In this way, a series of attached backer panels could easily be used to form a decorative display around the walls of a room.

The apparatus of the present invention may thus, as described above, be made or assembled in a large number of configurations so that it may suit the requirements of a wide variety of users to display and dispense paper and like objects in fields as diverse as art, education and advertising.

I claim:

1. An apparatus for displaying documents comprising a backer panel having four edges and made from a pliable material, said backer panel having a first means for attaching said backer panel to a surface and a second means for attaching said backer panel to another, like backer panel located on said four edges, a pliable back sheet attached to said backer panel by a third attaching means located on a rear side of said back sheet a pliable front sheet attached to said back sheet so as to form a pocket having a three fixed sides and an open side, said pocket adapted for the insertion and retention of a document.

* * * * *